US012054840B2

(12) United States Patent
Chang et al.

(10) Patent No.: US 12,054,840 B2
(45) Date of Patent: Aug. 6, 2024

(54) PLATING APPARATUS, PRE-WET PROCESS METHOD, AND CLEANING PROCESS METHOD

(71) Applicant: EBARA CORPORATION, Tokyo (JP)

(72) Inventors: Shao Hua Chang, Tokyo (JP); Masaya Seki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 120 days.

(21) Appl. No.: 17/612,024

(22) PCT Filed: Dec. 22, 2020

(86) PCT No.: PCT/JP2020/047931

§ 371 (c)(1),
(2) Date: Nov. 17, 2021

(87) PCT Pub. No.: WO2022/137339

PCT Pub. Date: Jun. 30, 2022

(65) Prior Publication Data

US 2022/0396897 A1 Dec. 15, 2022

(51) Int. Cl.
*C25D 21/08* (2006.01)
*C25D 5/08* (2006.01)
(Continued)

(52) U.S. Cl.
CPC ..... *C25D 21/08* (2013.01); *C25D 5/08* (2013.01); *C25D 5/48* (2013.01); *C25D 17/06* (2013.01)

(58) Field of Classification Search
None
See application file for complete search history.

(56) References Cited

U.S. PATENT DOCUMENTS 6,280,581 B1 * 8/2001 Cheng ..... C25D 5/08 204/224 R
2005/0145500 A1 7/2005 Toyoda et al.
(Continued)

FOREIGN PATENT DOCUMENTS

CN 101383271 A 3/2009
CN 203245737 * 10/2013 ..... B24B 37/04
(Continued)

OTHER PUBLICATIONS

English translation CN 101383271. (Year: 2009).*

*Primary Examiner* — Stefanie S Wittenberg
(74) *Attorney, Agent, or Firm* — BakerHostetler

(57) ABSTRACT

Provided is a technique that allows ensuring a downsized plating apparatus.

A plating apparatus includes a discharge module 50. The discharge module includes a module main body 51 including a plurality of nozzles 52 configured to discharge a process liquid upward, and a moving mechanism 60 including a rotation shaft 61 disposed at a side of a plating tank and connected to the module main body. The moving mechanism 60 moves the module main body by rotation of the rotation shaft. The moving mechanism moves the module main body between the first position and the second position. The plurality of nozzles are arranged such that the process liquid discharged from the plurality of nozzles is brought in contact with a lower surface of a substrate from a center portion to an outer peripheral edge portion when the module main body moves to the second position. The module main body further includes a recovery member configured to recover the process liquid dropped after being discharged from the plurality of nozzles and brought in contact with the lower surface of the substrate.

4 Claims, 7 Drawing Sheets

(A1-A1)

(51) Int. Cl.
*C25D 5/48* (2006.01)
*C25D 17/06* (2006.01)

(56) References Cited

U.S. PATENT DOCUMENTS

| | | | | |
|---|---|---|---|---|
| 2005/0282371 | A1* | 12/2005 | Patton | H01L 21/2885 257/E21.175 |
| 2015/0020852 | A1 | 1/2015 | Kato et al. | |
| 2016/0074913 | A1 | 3/2016 | Hanawa et al. | |
| 2016/0273119 | A1* | 9/2016 | He | C25D 21/10 |

FOREIGN PATENT DOCUMENTS

| | | | |
|---|---|---|---|
| JP | H03-013591 | A | 1/1991 |
| JP | H05-263290 | A | 10/1993 |
| JP | 2003-027291 | A | 1/2003 |
| JP | 2008-019496 | A | 1/2008 |
| JP | 2015-023048 | A | 2/2015 |
| JP | 2016-058665 | A | 4/2016 |
| JP | 2020-043333 | A | 3/2020 |
| TW | 200529286 | A | 9/2005 |

* cited by examiner (A)

(B)

(A1-A1)

(A2-A2)

PLATING APPARATUS, PRE-WET PROCESS METHOD, AND CLEANING PROCESS METHOD

TECHNICAL FIELD

The present invention relates to a plating apparatus, a pre-wet process method, and a cleaning process method.

BACKGROUND ART

Conventionally, there has been known what is called a cup type plating apparatus as a plating apparatus that can perform plating on a substrate (for example, see PTL 1). Such plating apparatus includes a plating tank with an anode therein, a substrate holder that is disposed above the anode and holds a substrate as a cathode, and a rotation mechanism that rotates the substrate holder.

Alternatively, conventionally, it has been performed that a pre-wet process of wetting a substrate with a predetermined process liquid is executed before the substrate is plated (that is, before execution of plating process), and a cleaning process of cleaning the substrate with a predetermined process liquid is executed after performing the plating process (for example, see PTL 2). Specifically, PTL 2 discloses a plating apparatus including a plating tank, a plating module that includes a substrate holder and a rotation mechanism and executes a plating process, a pre-wet module configured to execute a pre-wet process, and a cleaning module configured to execute a cleaning process.

CITATION LIST

Patent Literature

PTL 1: Japanese Unexamined Patent Application Publication No. 2008-19496

PTL 2: Japanese Unexamined Patent Application Publication No. 2020-43333

SUMMARY OF INVENTION

Technical Problem

Recently, downsizing of the plating apparatus has been desired. In this regard, the above-described conventional plating apparatus has a room for improvement in the aspect of downsizing of the plating apparatus.

The present invention has been made in view of the above, with an object to provide a technique of ensuring downsizing of a plating apparatus.

Solution to Problem

[Aspect 1] To achieve the above-described object, a plating apparatus according to one aspect of the present invention includes a plating module including a plating tank, a substrate holder, and a rotation mechanism. The plating tank includes an anode. The substrate holder is disposed above the anode for holding a substrate as a cathode. The rotation mechanism rotates the substrate holder. The plating module further includes a discharge module configured to discharge a predetermined process liquid toward a lower surface of the substrate held by the substrate holder. The discharge module includes a module main body including a plurality of nozzles configured to discharge the process liquid upward, and a moving mechanism including a rotation shaft disposed at a side of the plating tank and connected to the module main body. The moving mechanism moves the module main body by rotation of the rotation shaft. The moving mechanism is configured to move the module main body between a first position and a second position. The first position is a position at which the module main body is not between the substrate and the anode. The second position is a position at which the module main body is between the substrate with the anode and the process liquid discharged from the plurality of nozzles brought in contact with the lower surface of the substrate. The plurality of nozzles are configured such that the process liquid discharged from the plurality of nozzles is brought in contact with the lower surface of the substrate from a center portion to an outer peripheral edge portion when the module main body moves to the second position. The module main body further includes a recovery member configured to recover the process liquid dropped after being discharged from the plurality of nozzles and brought in contact with the lower surface of the substrate.

According to this aspect, by moving the module main body from the first position to the second position by the moving mechanism and discharging the process liquid from the plurality of nozzles while rotating the substrate holder by the rotation mechanism, the pre-wet process can be executed and the cleaning process can be executed. Therefore, according to this aspect, the pre-wet process and the cleaning process can be executed without providing a pre-wet module or a cleaning module separately from the plating module. Accordingly, downsizing of the plating apparatus can be ensured compared with a conventional plating apparatus including a pre-wet module and a cleaning module separately from the plating module.

According to this aspect, by bringing the process liquid in contact with the lower surface of the substrate entirely from the center portion to the outer peripheral edge portion, the lower surface of the substrate can be entirely wet and cleaned. According to this aspect, since the dropped process liquid can be recovered by the recovery member, entering of the dropped process liquid into the plating tank can be suppressed.

[Aspect 2] In Aspect 1 described above, the module main body may extend in a direction separating from the rotation shaft in plan view, and the plurality of nozzles may include a plurality of nozzles arranged in the extending direction of the module main body and a plurality of nozzles arranged also in a direction perpendicular to the extending direction of the module main body, in plan view.

[Aspect 3] In Aspect 1 or 2 described above, the recovery member may be provided with a depressed portion formed on an upper surface of the module main body, and the plurality of nozzles may be disposed in the depressed portion.

[Aspect 4] In any one of Aspects 1 to 3 described above, the process liquid may be pure water.

[Aspect 5] To achieve the above-described object, a pre-wet process method according to one aspect of the present invention is a pre-wet process method using the plating apparatus according to any one of Aspects 1 to 4 described above. The pre-wet process method includes performing a pre-wet process of wetting the lower surface of the substrate with the process liquid before performing a plating process of plating the lower surface of the substrate held by the substrate holder. The pre-wet process includes moving the module main body from the first position to the second position by the moving mechanism and discharging the process liquid from the plurality of nozzles while rotating the substrate holder by the rotation mechanism.

According to this aspect, since the pre-wet process can be executed without providing a pre-wet module separately from the plating module, downsizing of the plating apparatus can be ensured compared with a conventional plating apparatus including a pre-wet module separately from the plating module.

[Aspect 6] In Aspect 5 described above, the plating apparatus may further include an inclination mechanism configured to incline the substrate holder, and the pre-wet process may include inclining the substrate holder by the inclination mechanism such that in an outer peripheral edge of the substrate holder, a portion close to the rotation shaft is positioned lower than a portion far from the rotation shaft when the process liquid is discharged from the plurality of nozzles. According to this aspect, entering of the process liquid dropped after being discharged from the nozzles into the plating tank can be effectively suppressed.

[Aspect 7] To achieve the above-described object, a cleaning process method according to one aspect of the present invention is a cleaning process method using the plating apparatus according to any one of Aspects 1 to 4 described above. The cleaning process method includes performing a cleaning process of cleaning the lower surface of the substrate with the process liquid after performing a plating process of plating the lower surface of the substrate held by the substrate holder. The cleaning process includes moving the module main body from the first position to the second position by the moving mechanism and discharging the process liquid from the plurality of nozzles while rotating the substrate holder by the rotation mechanism.

According to this aspect, since the cleaning process can be executed without providing a cleaning module separately from the plating module, downsizing of the plating apparatus can be ensured compared with a conventional plating apparatus including a cleaning module separately from the plating module.

[Aspect 8] In Aspect 7 described above, the plating apparatus may further include an inclination mechanism configured to incline the substrate holder, and the cleaning process may include inclining the substrate holder by the inclination mechanism such that in an outer peripheral edge of the substrate holder, a portion close to the rotation shaft is positioned lower than a portion far from the rotation shaft when the process liquid is discharged from the plurality of nozzles. According to this aspect, entering of the process liquid dropped after being discharged from the nozzles into the plating tank can be effectively suppressed.

DESCRIPTION OF EMBODIMENTS

Figure 1:
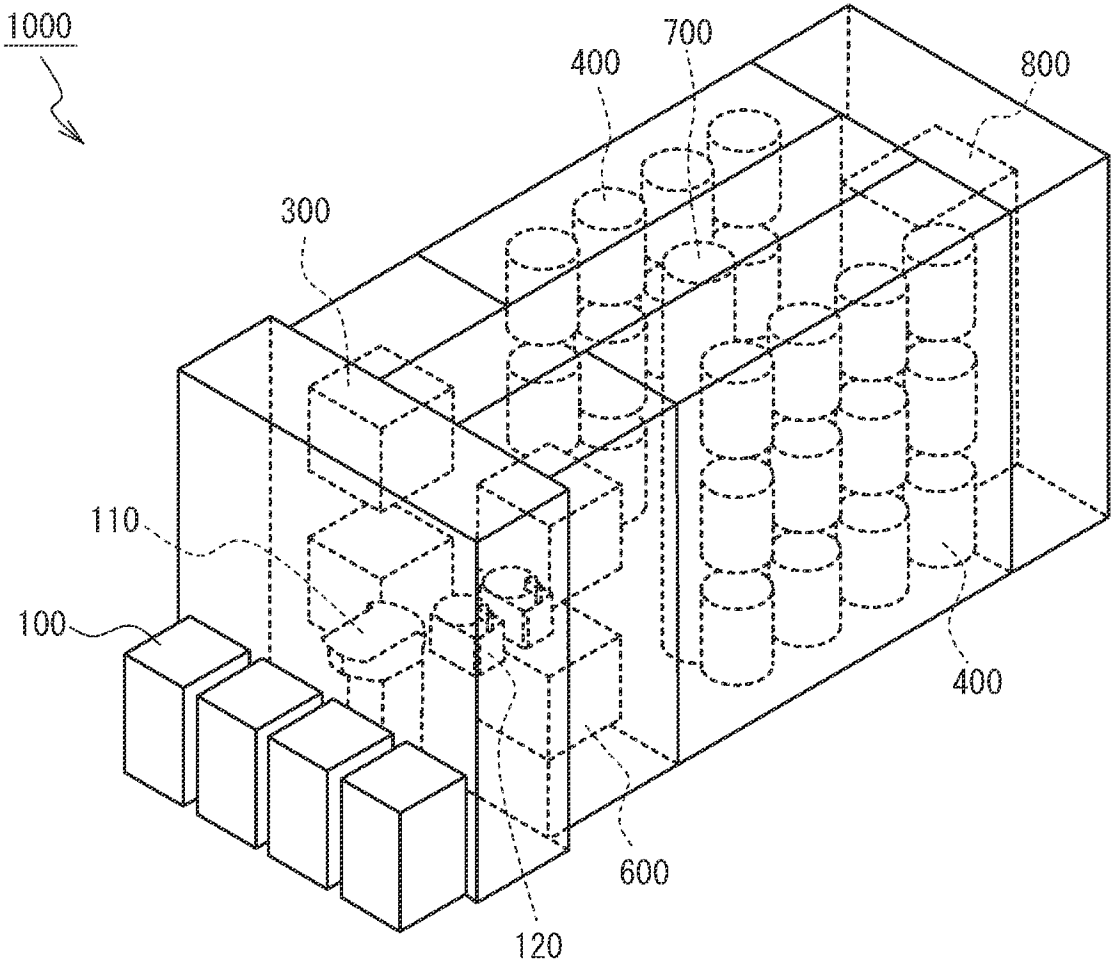
FIG. 1 is a perspective view illustrating an overall configuration of a plating apparatus according to an embodiment.

The following describes embodiments of the present invention with reference to the drawings. In the following respective embodiments and modifications of the embodiments, an identical reference numeral is attached to an identical or corresponding constitution and a description will be appropriately omitted in some cases. Furthermore, the drawings are schematically illustrated for ease of understanding features of the embodiments, and a dimensional proportion of each component is not always identical to that of an actual component. For some drawings, X-Y-Z orthogonal coordinates are illustrated for reference purposes. Of the orthogonal coordinates, the Z direction corresponds to the upper side, and the −Z direction corresponds to the lower side (the direction where gravity acts).

Figure 2:
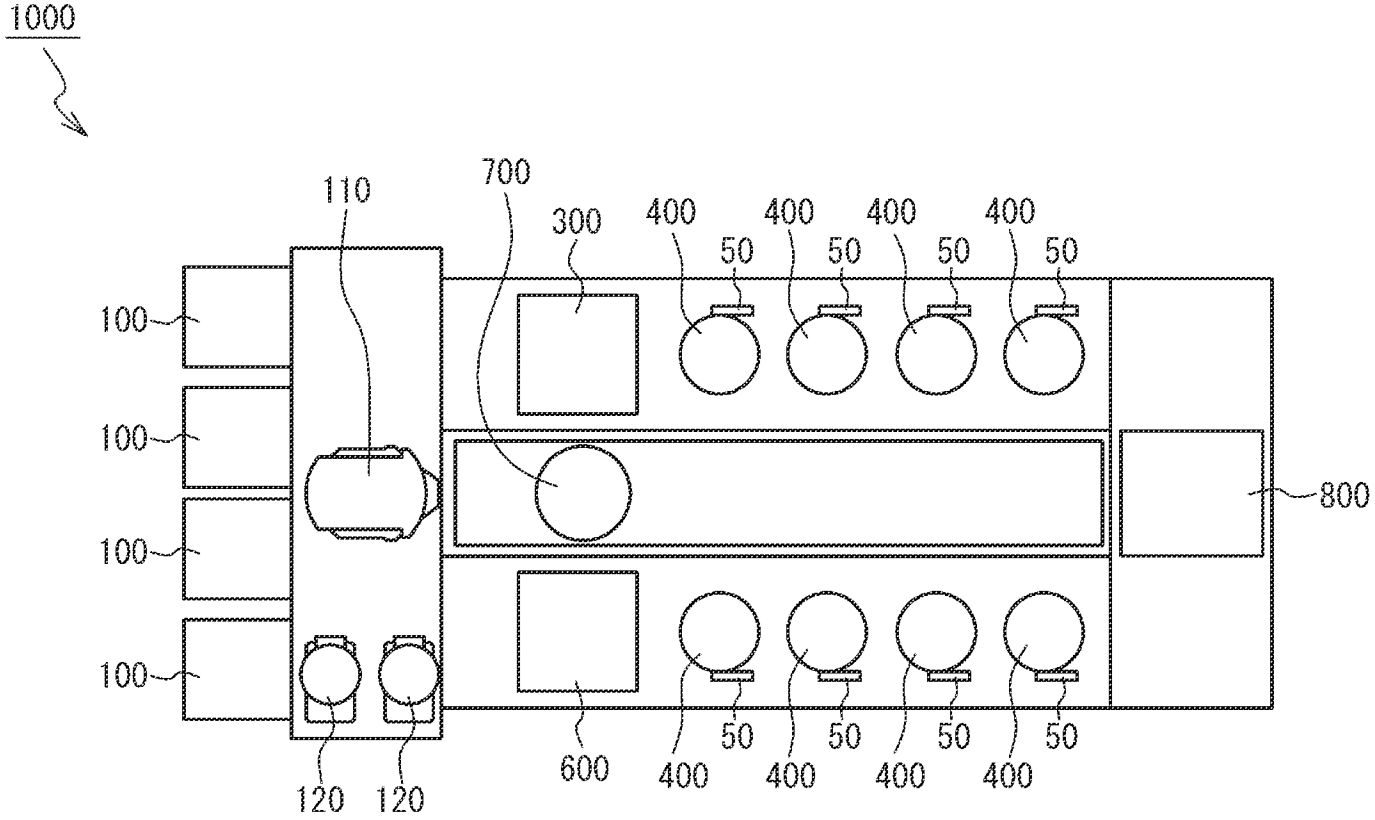
FIG. 2 is a plan view illustrating the overall configuration of the plating apparatus according to the embodiment.

FIG. 1 is a perspective view illustrating the overall configuration of a plating apparatus 1000 of this embodiment. FIG. 2 is a plan view illustrating the overall configuration of the plating apparatus 1000 of this embodiment. As illustrated in FIGS. 1 and 2, the plating apparatus 1000 includes load ports 100, a transfer robot 110, aligners 120, pre-soak modules 300, plating modules 400, spin rinse dryers 600, a transfer device 700, and a control module 800. While the plating module 400 according to the embodiment includes a discharge module 50, illustration of the discharge module 50 is omitted in FIG. 1.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transferring the substrate between the plurality of modules inside the plating apparatus 1000, The control module 800 is configured to control the plurality of modules in the plating apparatus 1000 and can be configured of, for example, a general computer including input/output interfaces with an operator or a dedicated computer.

The discharge module 50 is a module for performing a pre-wet process in which a lower surface (surface to be plated) of the substrate before performing the plating process is wet with a predetermined process liquid PL, thereby replacing air inside a pattern formed on the substrate surface with the process liquid PL. The discharge module 50 is also a module for performing a cleaning process of cleaning the lower surface of the substrate after performing the plating process with the process liquid PL to remove a plating solution and the like remaining on the substrate after performing the plating process. Thus, the discharge module 50 according to the embodiment has functions as a pre-wet module and a cleaning module. The discharge module 50 will be described in detail below.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the plating module 400. In the plating module 400, the discharge module 50 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

Next, the discharge module 50 performs the cleaning process on the substrate. The transfer device 700 transfers the substrate on which the cleaning process has been performed to the spin rinse dryer 600, The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

The configuration of the plating apparatus 1000 described in FIG. 1 and FIG. 2 is merely an example, and the configuration of the plating apparatus 1000 is not limited to the configuration of FIG. 1 and FIG. 2.

Subsequently, the plating module 400 will be described, Since a plurality of the plating modules 400 included in the plating apparatus 1000 according to this embodiment have similar configurations, only one plating module 400 will be described.

Figure 3:
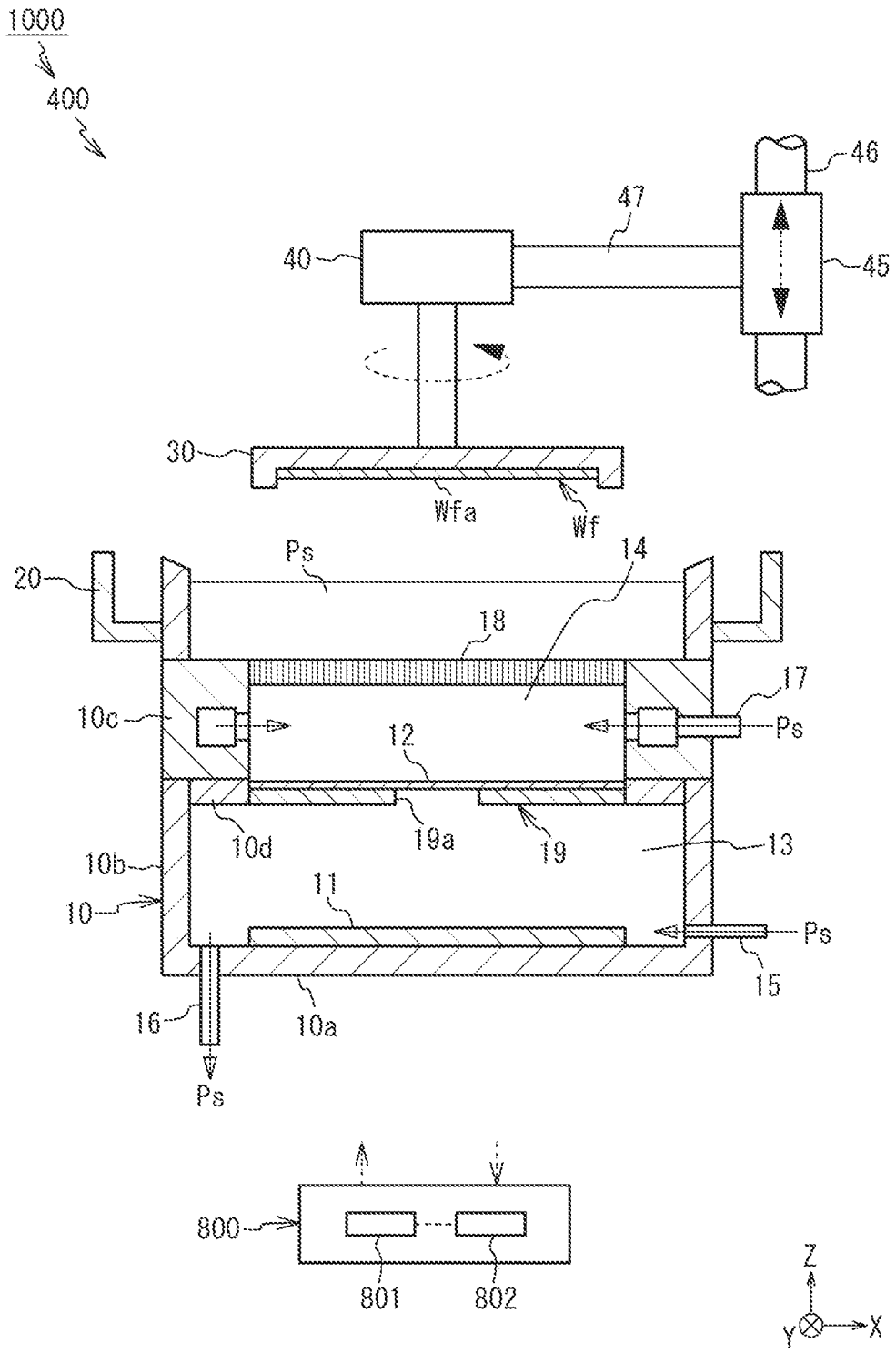
FIG. 3 is a diagram for describing a configuration of a plating module according to the embodiment.

FIG. 3 is a diagram for describing a configuration of the plating module 400 of the plating apparatus 1000 according to this embodiment. The plating apparatus 1000 according to this embodiment is a cup type plating apparatus. The plating module 400 of the plating apparatus 1000 according to this embodiment exemplified in FIG. 3 mainly includes a plating tank 10, an overflow tank 20, a substrate holder 30, a rotation mechanism 40, an elevating mechanism 45, and an inclination mechanism 47. As described above, while the plating module 400 also includes the discharge module 50, illustration of the discharge module 50 is omitted in FIG. 3. In FIG. 3, the cross-sectional surfaces of the plating tank 10, the overflow tank 20, and the substrate holder 30 are schematically illustrated.

The plating tank 10 according to this embodiment is configured by a container having an opening in its upper side and a bottom. Specifically, the plating tank 10 has a bottom wall portion 10*a*, and an outer peripheral wall portion 10*b* that extends upward from the outer periphery edge of this bottom wall portion 10*a*, and an upper portion of this outer peripheral wall portion 10*b* is opened. Although the shape of the outer peripheral wall portion 10*b* of the plating tank 10 is not specifically limited, the outer peripheral wall portion 10*b* according to this embodiment has a cylindrical shape as an example.

The plating tank 10 internally stores a plating solution Ps. It is only necessary that the plating solution Ps is a solution that contains metallic element ions for constituting the plating film, and the specific examples are not particularly limited. In this embodiment, a copper plating process is used as an example of the plating process, and a copper sulfate solution is used as an example of the plating solution Ps. Furthermore, in this embodiment, the plating solution Ps contains a predetermined additive. However, it is not limited to this configuration, and the plating solution Ps may have a configuration that does not contain the additive.

The plating tank 10 internally includes an anode 11. A specific type of the anode 11 is not particularly limited, and a soluble anode and/or an insoluble anode may be used. In this embodiment, an insoluble anode is used as an example of the anode 11. A specific type of this insoluble anode is not particularly limited, and platinum, iridium oxide, and the like may be used.

Inside the plating tank 10, a membrane 12 is disposed above the anode 11. Specifically, the membrane 12 is disposed in a position between the anode 11 and a substrate Wf. The membrane 12 according to this embodiment is, for example, connected to the outer peripheral wall portion 10*b* of the plating tank 10 via a holding member 10*d*, Furthermore, the membrane 12 according to this embodiment is arranged such that the membrane 12 has a surface direction in the horizontal direction.

The plating tank 10 is internally split into two parts in the vertical direction by the membrane 12. A region partitioned as a side below the membrane 12 is referred to as an anode chamber 13. A region in a side above the membrane 12 is referred to as a cathode chamber 14. The above-described anode 11 is disposed in the anode chamber 13.

The membrane 12 is configured by a membrane that allows metal ions to pass while suppressing the additive contained in the plating solution Ps to pass. That is, in this embodiment, the plating solution in the cathode chamber 14 contains the additive, but the plating solution Ps in the anode chamber 13 does not contain the additive. However, it is not limited to this configuration, and, for example, the plating solution Ps in the anode chamber 13 may also contain the additive. However, even in this case, a concentration of the additive in the anode chamber 13 is lower than a concentration of the additive in the cathode chamber 14. A specific type of the membrane 12 is not particularly limited and a known membrane may be used, Specific examples of this membrane 12 may include, for example, an electrolytic membrane, and as a specific example of this electrolytic membrane, an electrolytic diaphragm for plating manufactured by Yuasa Membrane Systems Co., Ltd., an ion exchange membrane, and the like may be used.

The plating tank 10 is provided with an anode supply port 15 for supplying the plating solution Ps to the anode chamber 13. Furthermore, the plating tank 10 is provided with an anode discharge port 16 for discharging the plating solution Ps in the anode chamber 13 from the anode chamber 13. The plating solution Ps discharged from the anode discharge port 16 is then temporarily stored in an anode reservoir tank (not illustrated) and later supplied again from the anode supply port 15 to the anode chamber 13.

The plating tank 10 is provided with a cathode supply port 17 for supplying the plating solution Ps to the cathode chamber 14. Specifically, a part of a portion corresponding to the cathode chamber 14 in the outer peripheral wall portion 10*b* of the plating tank 10 according to this embodiment is provided with a protrusion portion 10*c* that protrudes into a center side of the plating tank 10, and this protrusion portion 10*c* is provided with the cathode supply port 17.

The overflow tank 20 is disposed outside the plating tank 10 and configured by a container with a bottom. The overflow tank 20 is a tank disposed for temporarily storing the plating solution Ps that flows over an upper end of the outer peripheral wall portion 10*b* of the plating tank 10 (that is, the plating solution Ps that has overflowed from the plating tank 10). The plating solution Ps supplied from the cathode supply port 17 to the cathode chamber 14 flows into the overflow tank 20, and is then discharged from a discharge port (not illustrated) of the overflow tank 20, and is temporarily stored in a cathode reservoir tank (not illustrated). Then, the plating solution Ps is supplied again from the cathode supply port 17 to the cathode chamber 14.

In the cathode chamber 14 according to this embodiment, a porous ionically resistive element 18 is disposed. Specifically, the ionically resistive element 18 according to this embodiment is disposed in a position in a vicinity of an upper end of the protrusion portion 10*c*, The ionically resistive element 18 is configured by a porous plate member with a plurality of holes (pores). This ionically resistive element 18 is a member disposed for achieving the uniformity of the electric field formed between the anode 11 and the substrate Wf.

Furthermore, in this embodiment, the anode chamber 13 is provided with an anode mask 19. The anode mask 19 according to this embodiment is arranged such that an upper surface of the anode mask 19 is in contact with a lower surface of the membrane 12. However, it is only necessary that the arranged area of the anode mask 19 is in the anode chamber 13, and it is not limited to the area illustrated in FIG. 3. In another example, the anode mask 19 may be arranged in a position below the membrane 12 to make a space with the membrane 12. The anode mask 19 has an opening portion 19*a* through which electricity that flows between the anode 11 and the substrate Wf passes.

The substrate holder 30 is a member for holding the substrate Wf as the cathode. The substrate Wf has a lower surface Wfa corresponding to the surface to be plated. The substrate holder 30 is connected to the rotation mechanism 40, The rotation mechanism 40 is a mechanism for rotating the substrate holder 30. As the rotation mechanism 40, a known mechanism, such as a rotation motor, can be used. The rotation mechanism 40 is connected to the elevating mechanism 45. The elevating mechanism 45 is supported by a spindle 46 extending in the vertical direction. The elevating mechanism 45 is a mechanism for moving the substrate holder 30, the rotation mechanism 40, and the inclination mechanism 47 up and down in the vertical direction. As the elevating mechanism 45, a known elevating mechanism, such as an actuator of a linear motion type, can be used. The inclination mechanism 47 is a mechanism for inclining the substrate holder 30 and the rotation mechanism 40. As the inclination mechanism 47, a known inclination mechanism, such as a piston-cylinder, can be used.

When the plating process is executed, the rotation mechanism 40 rotates the substrate holder 30 while the elevating mechanism 45 moves the substrate holder 30 downward and immerses the substrate Wf in the plating solution Ps in the plating tank 10. Subsequently, an energization device causes electricity to flow between the anode 11 and the substrate Wf. Accordingly, the plating film is formed on the lower surface Wfa of the substrate Wf (that is, the plating process is performed).

An operation of the plating module 400 is controlled by the control module 800. The control module 800 includes a microcomputer, and this microcomputer includes a CPU (Central Processing Unit) 801 as a processor, a storage unit 802 as a non-transitory storage medium, and the like. In the control module 800, the CPU 801 controls the operation of the plating module 400 based on commands of a program stored in the storage unit 802.

In this embodiment, one control module 800 functions as a control device that integrally controls controlled units of the plating modules 400, but it is not limited to this configuration. For example, the control module 800 may include a plurality of the control devices, and these plurality of control devices may individually control the respective controlled units of the plating modules 400.

Figure 4:
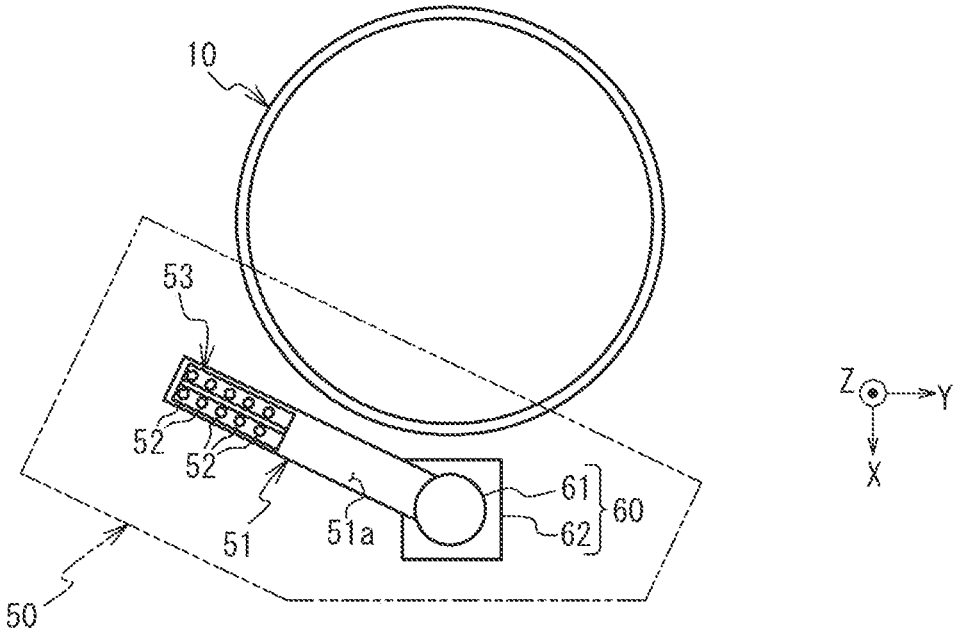
FIG. 4(A) and FIG. 4(B) are schematic plan views of a discharge module according to the embodiment.
Figure 4:
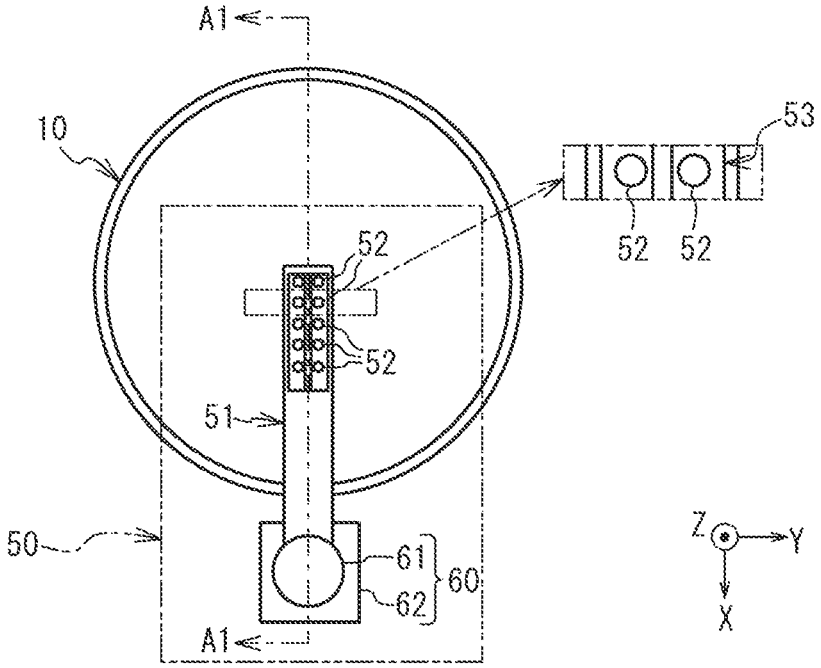
Figure 5:
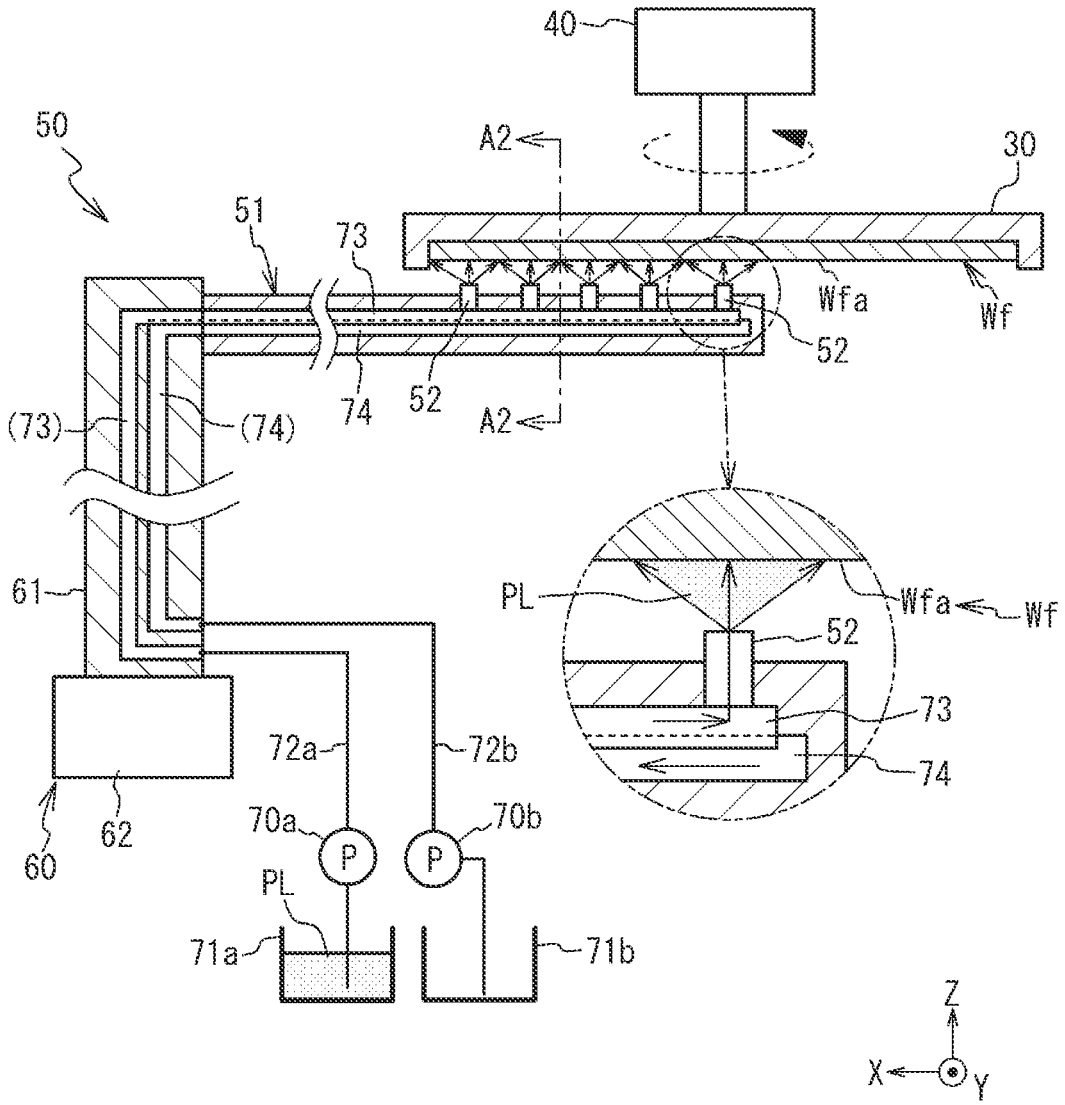
FIG. 5 is a schematic diagram illustrating an overall configuration of the discharge module according to the embodiment.
Figure 6:
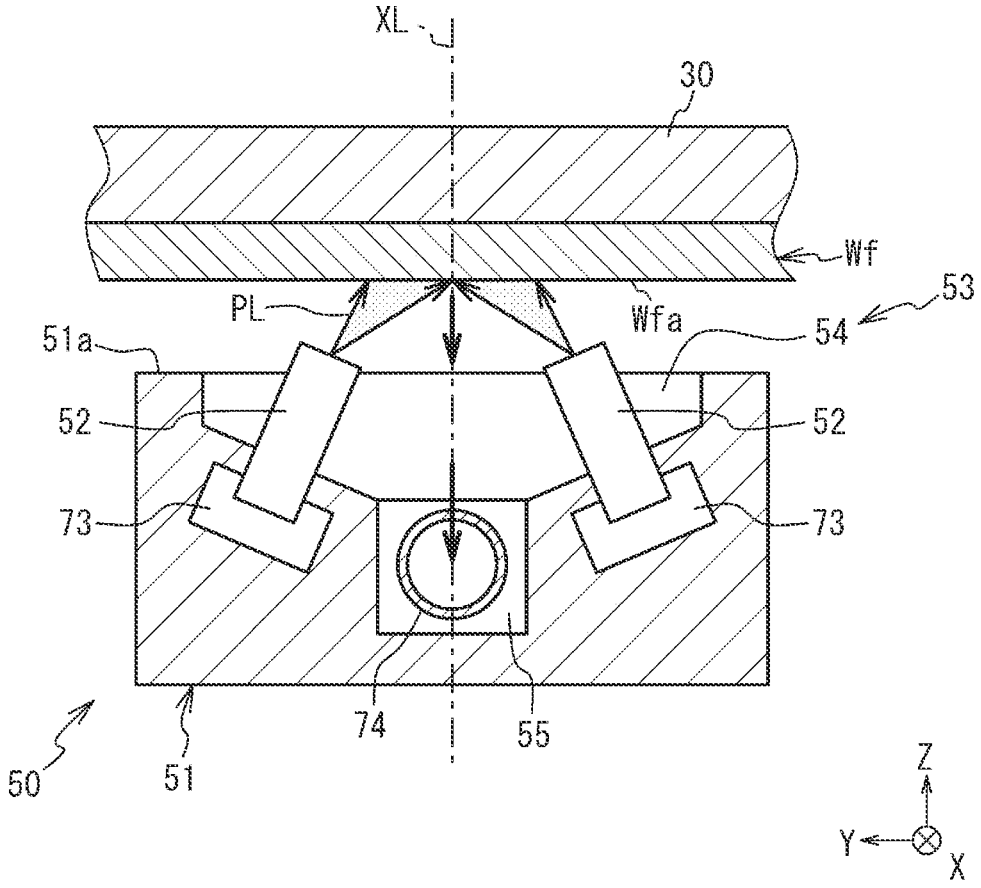
FIG. 6 is a cross-sectional view schematically illustrating a cross-sectional surface taken along a line A2-A2 of FIG. 5.

Subsequently, the discharge module 50 will be described in detail. FIG. 4(A) and FIG. 4(B) are schematic plan views of the discharge module 50. Specifically, FIG. 4(A) illustrates a state where a module main body 51 described later of the discharge module 50 is at a first position, and FIG. 4(B) illustrates a state where the module main body 51 is at a second position. In FIG. 4(A) and FIG. 4(B), while the plating tank 10 is also illustrated in addition to the discharge module 50, illustration of an internal configuration of the plating tank 10 is omitted. FIG. 5 is a schematic diagram illustrating the overall configuration of the discharge module 50. In FIG. 5, for the module main body 51 and a rotation shaft 61 of the discharge module 50, a cross-sectional surface taken along a line A1-A1 of FIG. 4(B) is schematically illustrated. In FIG. 5, illustration of the plating tank 10 is omitted, and the substrate holder 30 and the rotation mechanism 40 are illustrated for instead. FIG. 6 is a schematic cross-sectional view illustrating the cross-sectional surface taken along a line A2-A2 of FIG. 5. The discharge module 50 will be described with reference to these drawings as follows.

As illustrated in FIG. 5, the discharge module 50 mainly includes the module main body 51, a moving mechanism 60, pumps (pump 70*a* and pump 70*b*), reservoir tanks (reservoir tank 71*a* and reservoir tank 71*b*), and pipes (pipe 72*a* and pipe 72*b*).

As illustrated in FIG. 4(A) and FIG. 4(B), the module main body 51 according to the embodiment has, for example, a shape extending in a direction separating from the rotation shaft 61 described later in plan view (top view), Specifically, the module main body 51 has a rectangular shape with a long side in the direction separating from the rotation shaft 61 and a short side in a direction perpendicular to the long side. As illustrated in FIG. 4(A), FIG. 4(B). FIG. 5, and FIG. 6, the module main body 51 includes at least one nozzle 52 configured to discharge the process liquid PL upward. The module main body 51 according to the embodiment also include a recovery member 53.

Specifically, the number of the nozzles 52 according to the embodiment is plural. As a specific example, in the plurality of nozzles 52 according to the embodiment, a plurality of nozzles 52 (for example, five) are arranged in the extending direction (longitudinal direction) of the module main body 51, and a plurality of nozzles 52 (for example, two) are arranged in a direction perpendicular to the extending direction (lateral direction (or width direction)). Specifically, the two nozzles 52 arranged in the lateral direction are disposed one by one in one side and the other side across a center axis line XL of a depressed portion 54 described later in cross-sectional view of the module main body 51 taken in the lateral direction as illustrated in FIG. 6. Consequently, the number of the plurality of nozzles 52 according to the embodiment is ten in total. However, the number of the nozzles 52 is not limited to this, and the number may be less than ten and may be more than ten.

With reference to FIG. 5, in the embodiment, the arrangement position of the plurality of nozzles 52 is set such that the process liquid PL discharged from the nozzles 52 is brought in contact with the lower surface Wfa of the substrate Wf from the center portion to the outer peripheral edge portion when the module main body 51 is at the second position described later. The nozzles 52 are each configured to inject the process liquid PL upward in wide angle (that is, in fan shape). Specifically, the nozzles 52 are each provided with a discharge port to inject the process liquid PL in wide angle, and the process liquid PL is injected upward in wide angle from this discharge port.

While the process liquid PL discharged from the nozzles 52 only needs to be a liquid with which the pre-wet process and the cleaning process can be executed, and the specific type is not particularly limited, pure water is used as a specific example in this embodiment. Preferably, the pure water having an electrical resistivity of, for example, "0.1 (MΩ·cm)" or more is used. As the pure water, a pure water from which air is removed (that is, degassed pure water) may be used, a pure water that has not been degassed may be used, or a pure water from which ions are removed (that is, deionized water) may be used.

With reference to FIG. 4(A) and FIG. 4(B), the moving mechanism 60 is a mechanism for moving the module main body 51. Specifically, the moving mechanism 60 is configured to move the module main body 51 between the "first position (FIG. 4(A))" at which the module main body 51 is not between the substrate Wf and the anode 11 and the "second position (FIG. 4(B))" at which the module main body 51 is between the substrate Wf and the anode 11 and the process liquid PL discharged from the nozzles 52 is in contact with the lower surface Wfa of the substrate Wf. In this embodiment, the second position is specifically a position at which the nozzles 52 are positioned immediately below the lower surface Wfa of the substrate Wf, and in other words, a position at which the nozzles 52 are opposed to the lower surface Wfa of the substrate Wf.

As illustrated in FIG. 5, the moving mechanism 60 according to the embodiment includes the rotation shaft 61 and an actuator 62. The rotation shaft 61 is disposed at a side of the plating tank 10. The rotation shaft 61 is connected to the module main body 51, The actuator 62 is a device for driving the rotation shaft 61. In FIG. 5, the rotation shaft 61 rotates about the Z-axis. By the rotation of the rotation shaft 61 driven by the actuator 62, the module main body 51 moves between the first position and the second position. As the actuator 62, for example, a known actuator that includes a motor configured to rotate in one rotation direction and the other rotation direction (that is, a motor configured to normally rotate and reversely rotate) and the like can be used. Operations of the actuator 62 is controlled by the control module 800.

A supply passage 73 and a discharge passage 74 are disposed inside the module main body 51 and inside the rotation shaft 61 according to the embodiment. The supply passage 73 and the discharge passage 74 may be connected to the pipes (pipe 72*a*, pipe 72*b*) described later passing outside the rotation shaft 61 instead of internally passing through the rotation shaft 61. The supply passage 73 is a flow passage through which the process liquid PL supplied to the nozzles 52 flows. The discharge passage 74 is a flow passage through which the process liquid PL recovered by the recovery member 53 described later flows.

The supply passage 73 is communicated with the reservoir tank 71*a* via the pipe 72*a*. The reservoir tank 71*a* stores the process liquid PL. The pump 70*a* is disposed to the pipe 72*a*. When the pump 70*a* is driven by a command from the control module 800, the process liquid PL stored in the reservoir tank 71*a* is suctioned by the pump 70*a*, flows through the pipe 72*a* and the supply passage 73, and is discharged from the nozzles 52. The discharge passage 74 is communicated with the reservoir tank 71*b* via the pipe 72*b*. The pump 70*b* is connected to the pipe 72*b*.

With reference to FIG. 4(B), FIG. 5, and FIG. 6, the recovery member 53 is a portion configured to recover the process liquid PL discharged from the plurality of nozzles 52 and dropped after contacting the lower surface Wfa of the substrate Wf. Thus, according to the embodiment, since the process liquid PL dropped after being discharged upward from the plurality of nozzles 52 can be recovered by the recovery member 53, entering of the dropped process liquid PL into the plating tank 10 can be suppressed.

Specifically, as illustrated in FIG. 6, the recovery member 53 according to the embodiment is provided with the depressed portion 54 formed in an upper surface 51*a* of the module main body 51. A groove 55 is formed in the center of a bottom portion of the depressed portion 54, and the above-described discharge passage 74 is disposed in the groove 55. The discharge passage 74 is provided with a suction opening (not illustrated) through which the process liquid PL recovered in the depressed portion 54 of the recovery member 53 flows in the discharge passage 74. A specific position at which the suction opening is formed is not particularly limited, and for example, the suction opening may be formed at an upstream-side end portion of the discharge passage 74, and may be formed in a side surface of the discharge passage 74 (side surface of the pipe constituting the discharge passage 74).

When the inside of the discharge passage 74 becomes a negative pressure caused by driving of the pump 70*b* by the command from the control module 800, the process liquid PL recovered by the recovery member 53 flows in the discharge passage 74 from the suction opening, then flows through the pipe 72*b*, and is stored in the reservoir tank 71*b*.

In this embodiment, the plurality of nozzles 52 of the module main body 51 are disposed in the depressed portion 54. Accordingly, the process liquid PL dropped after being discharged from the plurality of nozzles 52 can be effectively recovered by the depressed portion 54.

In this embodiment, the nozzles 52 disposed in the one side and the nozzles 52 disposed in the other side across the center axis line XL of the depressed portion 54 each discharge the process liquid PL upward and toward the center side of the depressed portion 54. Accordingly, the process liquid PL discharged from the plurality of nozzles 52 and brought in contact with the lower surface Wfa. of the substrate Wf can be easily dropped toward the center side of the depressed portion 54. Also in this respect, the process liquid PL can be effectively recovered by the depressed portion 54.

Subsequently, the operation of the plating apparatus 1000 in the pre-wet process and the cleaning process according to the embodiment will be described. That is, a pre-wet process method and a cleaning process method using the plating apparatus 1000 according to the embodiment will be described.

First, the control module 800 moves the module main body 51 to the first position in normal operation (FIG. 4(A)). When the pre-wet process is executed, the control module 800 controls the moving mechanism 60 to rotate the rotation shaft 61, thereby moving the module main body 51 to the second position (FIG. 4(B)). Next, the control module 800 controls the rotation mechanism 40 to rotate the substrate holder 30 and drive the pump 70*a*, thus causing the nozzles 52 to discharge the process liquid PL. The control module 800 drives the pump 70*b* simultaneously with the driving of the pump 70*a*, thereby returning the process liquid PL recovered by the recovery member 53 to the reservoir tank 71*b*.

By discharging the process liquid PL from the nozzles 52 while rotating the substrate holder 30, the process liquid PL is attached to the entire lower surface Wfa of the substrate Wf held by the substrate holder 30, thereby allowing wetting the entire lower surface Wfa of the substrate Wf with the process liquid PL. As described above, the pre-wet process is executed.

After ending the pre-wet process, the control module 800 stops the rotation of the substrate holder 30 by the rotation mechanism 40, and stops the pump 70*a* and the pump 70*b*. By stopping the pump 70*a*, the discharge of the process liquid PL from the nozzles 52 is stopped, and by stopping the pump 70*b*, the recovery of the process liquid PL by the recovery member 53 is stopped. Next, the control module 800 rotates the rotation shaft 61 to move the module main body 51 to the first position.

The control module 800 performs a control similar to that in the case of the above-described pre-wet process also in the execution of the cleaning process performed after performing the plating process. Specifically, the control module 800 controls the moving mechanism 60 to rotate the rotation shaft 61, thereby moving the module main body 51 to the second position. Next, the control module 800 controls the rotation mechanism 40 to rotate the substrate holder 30 and drive the pump 70*a*, thus causing the nozzles 52 to discharge the process liquid PL. The control module 800 drives the pump 70*b* simultaneously with the driving of the pump 70*a*, thereby returning the process liquid PL recovered by the recovery member 53 to the reservoir tank 71*b*.

By discharging the process liquid PL from the nozzles 52 while rotating the substrate holder 30, the entire lower surface Wfa of the substrate Wf held by the substrate holder 30 can be cleaned with the process liquid PL. As described above, the cleaning process is executed. After ending the cleaning process, the control module 800 stops the rotation of the substrate holder 30 by the rotation mechanism 40, and stops the pump 70*a* and the pump 70*b*. The module main body 51 is moved to the first position.

According to the embodiment as described above, the pre-wet process can be executed and the cleaning process can be executed by the discharge module 50. That is, the discharge module 50 can provide the functions as a pre-wet module configured to execute the pre-wet process and a cleaning module configured to execute the cleaning process. Accordingly, since the pre-wet process and the cleaning process can be executed without providing a pre-wet module or a cleaning module separately from the plating module 400, downsizing of the plating apparatus 1000 can be ensured compared with a conventional plating apparatus including a pre-wet module and a cleaning module separately from the plating module 400.

According to the embodiment, since the downsized plating apparatus 1000 can be ensured as described above, a transfer distance of the substrate Wf can be shortened. Accordingly, the throughput of the plating apparatus 1000 can be improved.

According to the embodiment, since the plurality of nozzles 52 are arranged such that the process liquid PL discharged from the nozzles 52 is brought in contact with the lower surface Wfa of the substrate Wf from the center portion to the outer peripheral edge portion, the lower surface Wfa can be entirely wet and cleaned with the process liquid PL brought in contact with the lower surface Wfa of the substrate Wf entirely from the center portion to the outer peripheral edge portion.

(Modification 1)

In the above-described embodiment, while the plating apparatus 1000 executes both of the pre-wet process and the cleaning process using the discharge module 50, the configuration is not limited to this. For example, the plating apparatus 1000 may execute only the pre-wet process by the discharge module 50 without performing the cleaning process by the discharge module 50. In this case, the plating apparatus 1000 preferably includes a cleaning module configured to execute the cleaning process separately from the plating module 400.

Also in this modification, since the pre-wet process can be executed without providing a pre-wet module separately from the plating module 400, downsizing of the plating apparatus 1000 can be ensured compared with a conventional plating apparatus including a pre-wet module separately from the plating module 400.

(Modification 2)

Alternatively, the plating apparatus 1000 may execute only the cleaning process by the discharge module 50 without performing the pre-wet process by the discharge module 50. In this case, the plating apparatus 1000 preferably includes a pre-wet module configured to execute the pre-wet process separately from the plating module 400.

Also in this modification, since the cleaning process can be executed without including a cleaning module separately from the plating module 400, downsizing of the plating apparatus 1000 can be ensured compared with a conventional plating apparatus including a cleaning module separately from the plating module 400.

(Modification 3)

Figure 7:
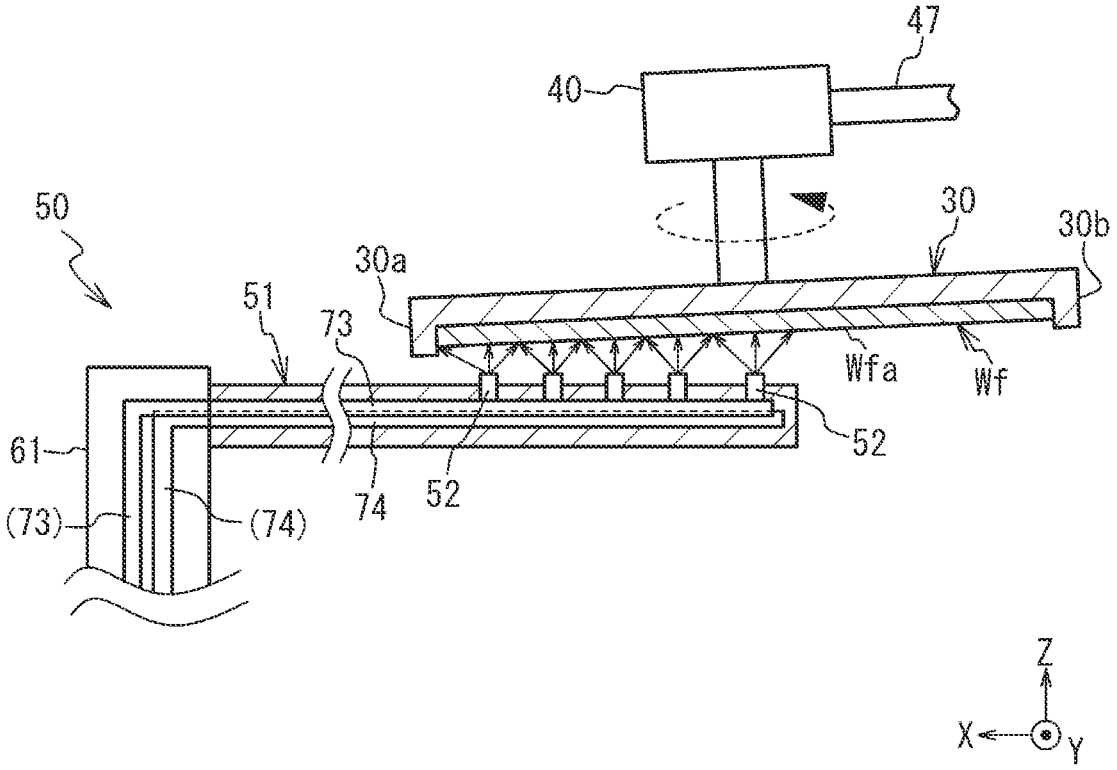
FIG. 7 is a schematic diagram of a peripheral configuration of a substrate holder when a pre-wet process or a cleaning process according to Modification 3 of the embodiment is executed.

FIG. 7 is a schematic diagram of a peripheral configuration of the substrate holder 30 when the pre-wet process or the cleaning process according to this modification is executed. In the embodiment or Modification 1 described above, the pre-wet process may further include inclining the substrate holder 30 by the inclination mechanism 47 such that, in the outer peripheral edge of the substrate holder 30, a portion 30*a* close to the rotation shaft 61 is positioned lower than a portion 30*h* far from the rotation shaft 61 when the process liquid PL is discharged from the nozzles 52. That is, in this case, in the pre-wet process, the process liquid PL is discharged from the nozzles 52 while the substrate holder 30 rotates in the state where the substrate holder 30 is inclined as described above.

Similarly, in the embodiment or Modification 2 described above, the cleaning process may further include inclining the substrate holder 30 by the inclination mechanism 47 such that, in the outer peripheral edge of the substrate holder 30, the portion 30*a* close to the rotation shaft 61 is positioned lower than the portion 30*b* far from the rotation shaft 61 when the process liquid PL is discharged from the nozzles 52. That is, in this case, in the cleaning process, the process liquid PL is discharged from the nozzles 52 while the substrate holder 30 rotates in the state where the substrate holder 30 is inclined as described above.

According to this modification, entering of the process liquid PL dropped after being discharged from the nozzles 52 into the plating tank 10 can be effectively suppressed.

Although the embodiment and the modifications according to the present invention have been described in detail above, the present invention is not limited to such specific embodiment and modifications, and various kinds of variants and modifications are possible within the scope of the gist of the present invention described in the claims.

REFERENCE SIGNS LIST

10 . . . plating tank
11 . . . anode
30 . . . substrate holder
40 . . . rotation mechanism
47 . . . inclination mechanism
50 . . . discharge module
51 . . . module main body
51*a* . . . upper surface
52 . . . nozzle
53 . . . recovery member
54 . . . depressed portion
60 . . . moving mechanism
61 . . . rotation shaft
400 . . . plating module
1000 . . . plating apparatus
Wf . . . substrate
Wfa . . . lower surface
Ps . . . plating solution
PL . . . process liquid

The invention claimed is:

1. A plating apparatus comprising:

a plating module including a plating tank, a substrate holder, and a rotation mechanism, the plating tank including an anode, the substrate holder being disposed above the anode for holding a substrate as a cathode, and the rotation mechanism rotating the substrate holder, wherein the plating module further includes a discharge module configured to discharge a predetermined process liquid toward a lower surface of the substrate held by the substrate holder, wherein the discharge module includes:

a module main body including a plurality of nozzles configured to discharge the process liquid upward; and a moving mechanism including a rotation shaft disposed at a side of the plating tank and connected to the module main body, the moving mechanism moving the module main body by rotation of the rotation shaft, wherein the moving mechanism is configured to move the module main body between a first position and a second position, the first position is a position at which the module main body is not between the substrate and the anode, and the second position is a position at which the module main body is between the substrate and the anode with the process liquid discharged from the plurality of nozzles brought in contact with the lower surface of the substrate, the plurality of nozzles are configured such that the process liquid discharged from the plurality of nozzles is brought in contact with the lower surface of the substrate from a center portion to an outer peripheral edge portion when the module main body moves to the second position, and the module main body further includes a recovery member configured to recover the process liquid dropped after being discharged from the plurality of nozzles and brought in contact with the lower surface of the substrate, the module main body extends in a direction outward from the rotation shaft in plan view, and the plurality of nozzles comprising a plurality of sets of at least two nozzles of the plurality nozzles arranged in the extending direction of the module main body, wherein the at least two nozzles in each of the plurality of sets of nozzles are spaced apart in a width direction of the module main body in plan view, the recovery member is provided with a depressed portion formed on an upper surface of the module main body, and the plurality of nozzles are disposed in the depressed portion.

2. The plating apparatus according to claim 1, wherein the process liquid is pure water.

3. The plating apparatus according to claim 1, wherein the plating apparatus further includes an inclination mechanism configured to incline the substrate holder, and a control module configured to control the plating apparatus, wherein the control module performs a pre-wet process of wetting the lower surface of the substrate with the process liquid before performing a plating process of plating the lower surface of the substrate held by the substrate holder, wherein the pre-wet process includes moving the module main body from the first position to the second position by the moving mechanism and discharging the process liquid from the plurality of nozzles while rotating the substrate holder by the rotation mechanism, and the pre-wet process includes inclining the substrate holder by the inclination mechanism such that in an outer peripheral edge of the substrate holder, a portion close to the rotation shaft is positioned lower than a portion far from the rotation shaft when the process liquid is discharged from the plurality of nozzles.

4. The plating apparatus according to claim 1, wherein the plating apparatus further includes an inclination mechanism configured to incline the substrate holder, and a control module configured to control the plating apparatus, wherein the control module performs a cleaning process of cleaning the lower surface of the substrate with the process liquid after performing a plating process of plating the lower surface of the substrate held by the substrate holder, wherein the cleaning process includes moving the module main body from the first position to the second position by the moving mechanism and discharging the process liquid from the plurality of nozzles while rotating the substrate holder by the rotation mechanism, and the cleaning process includes inclining the substrate holder by the inclination mechanism such that in an outer peripheral edge of the substrate holder, a portion close to the rotation shaft is positioned lower than a portion far from the rotation shaft when the process liquid is discharged from the plurality of nozzles.

* * * * *